US012134865B2

(12) United States Patent
Oettinger et al.

(10) Patent No.: US 12,134,865 B2
(45) Date of Patent: Nov. 5, 2024

(54) ROAD CONSTRUCTION MACHINE WITH AIR BARRIER DEVICE AND METHOD

(71) Applicant: JOSEPH VOEGELE AG, Ludwigshafen/Rhein (DE)

(72) Inventors: Klaus Oettinger, Altlussheim (DE); Bastian Fleischer, Waghaeusel (DE); Tobias Boellert, Kaiserslautern (DE); Daniel Draxler, Mannheim (DE); Ingo Herzberg, Angelbachtal (DE); Maximilian Theobald, Ludwigshafen (DE); Thomas Seither, Waldsee (DE); Frank Grimm, Edingen-Neckarhausen (DE); Helmut Kessler, Kaiserslautern (DE); Johannes Pontius, Schmelz (DE); Stefan Weber, Roedersheim-Gronau (DE); Bernhard Erdtmann, Edingen Neckarhausen (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 181 days.

(21) Appl. No.: 17/749,967

(22) Filed: May 20, 2022

(65) Prior Publication Data

US 2022/0372715 A1 Nov. 24, 2022

(30) Foreign Application Priority Data

May 20, 2021 (EP) ..... 21174880

(51) Int. Cl.
*E01C 19/48* (2006.01)

(52) U.S. Cl.
CPC ..... *E01C 19/48* (2013.01); *E01C 2301/50* (2013.01)

(58) Field of Classification Search
CPC ... E01C 19/48; E01C 2301/50; E01C 2301/30
See application file for complete search history.

(56) References Cited

U.S. PATENT DOCUMENTS 8,950,803 B2 * 2/2015 Herzberg ..... B60J 7/16 296/210
9,212,458 B2 12/2015 Kappel
(Continued)

FOREIGN PATENT DOCUMENTS

DE 20 2004 004 748 U1 6/2004
DE 20 2012 002 966 U1 4/2012
(Continued)

OTHER PUBLICATIONS

European Search Report Dated Oct. 27, 2021, Application No. 21174880.1-1002, Applicant Joseph Voegele AG, 8 Pages.

*Primary Examiner* — Carib A Oquendo
(74) *Attorney, Agent, or Firm* — Brooks Kushman P.C.

(57) ABSTRACT

The disclosure refers to a road construction machine, adapted in particular in the form of a road paver or a feeder vehicle for a road paver. According to the disclosure, the road construction machine comprises a first and/or a second air barrier device adapted to shield a driver and/or an operator of the road construction machine. Furthermore, the disclosure refers to a corresponding method for generating an air flow during operation of a road construction machine in order to shield a driver and/or an operator from vapors and/or aerosols rising during operation of the road construction machine.

19 Claims, 4 Drawing Sheets

(56) References Cited

U.S. PATENT DOCUMENTS

| | | | | |
|---|---|---|---|---|
| 9,212,460 | B2 * | 12/2015 | Komm | A63F 9/0857 |
| 2010/0269530 | A1 * | 10/2010 | Ichikawa | B60H 1/00021 62/244 |
| 2015/0008094 | A1 * | 1/2015 | Erdtmann | B65G 33/00 198/300 |
| 2020/0079175 | A1 * | 3/2020 | Fiocchi | B60H 3/0608 |

FOREIGN PATENT DOCUMENTS

| | | | |
|---|---|---|---|
| DE | 10 2012 007 869 | A1 | 9/2013 |
| DE | 20 2018 104 562 | U1 | 11/2019 |
| DE | 10 2020 123 723 | A1 | 3/2021 |
| EP | 0 843 044 | A1 | 5/1998 |
| JP | 2014-139388 | A | 7/2014 |
| JP | 2014-139389 | A | 7/2014 |
| JP | 2015-101898 | A | 6/2015 |
| WO | 2013/185867 | A1 | 12/2013 |

* cited by examiner

ROAD CONSTRUCTION MACHINE WITH AIR BARRIER DEVICE AND METHOD

CROSS-REFERENCE TO RELATED APPLICATIONS

This application claims foreign priority benefits under 35 U.S.C. § 119(a)-(d) to European patent application number EP 21174880.1, filed May 20, 2021, now European patent number EP 4092191 B1, issued Feb. 28, 2024, which is incorporated by reference in its entirety.

TECHNICAL FIELD

The present disclosure refers to a road construction machine, in particular a road paver or a feeder vehicle for a road paver. Furthermore, the disclosure refers to a method for generating an air flow during operation of a road construction machine.

BACKGROUND

During operation of a road construction machine, in particular during a paving run of a road paver or a feeder vehicle driving ahead of the road paver supplying the road paver with a paving material, vapors and bituminous aerosols may be generated in the immediate vicinity of the road paver or the feeder vehicle. This can occur in particular when hot paving material is transported or paved.

EP 0 843 044 A1 discloses a road paver and a feeder with an extraction system adapted to extract vapors and aerosols from an area above the spreading auger positioned in front of the paving screed and to discharge them above the overhead guard of an operating platform. Furthermore, the extraction system is adapted to extract vapors from a hopper area for paving material and discharge them above the roof structure. On the feeder vehicle, the extraction system can extract vapors and aerosols generated in the hopper area as well as vapors and aerosols generated along a conveyor device of the feeder and discharge them above the roof structure in order to reduce a concentration of vapors and aerosols in the environment of the feeder vehicle.

DE 10 2012 007 869 A1 also discloses a road paver with an extraction device by means of which vapors and aerosols can be extracted along a longitudinal transport device for paving material, which runs below the operating platform inside the chassis, and fed into an exhaust gas discharge system so that the vapors are blown out into the environment together with exhaust gases from an exhaust pipe ending above the overhead guard.

JP 2014-139 388 A discloses another extraction system adapted to extract from an area of the transverse spreader that distributes the paving material sideways in front of the paving screed, and discharge it above a driver's operating area.

The aforementioned extraction devices are adapted to extract vapors and/or aerosols from road pavers or feeder vehicles at the point of origin and to discharge them above a roof structure or above an operating platform built for the driver. The disadvantage of this is that experience has shown that the performance of these extraction systems is not fully sufficient to prevent vapors and/or aerosols from entering the driver's operating area or other operating areas provided on the road paver or feeder that are intended for an operator.

WO 2013/185867 A1 discloses an extraction device, the extraction opening of which is associated with an area of the transverse distribution auger of a road paver, wherein a blowing device is further provided above the area of the material distribution for forming an air purge covering the extraction flow horizontally.

JP 2014-139 389 A discloses a road paver with a blowing device positioned at the front of an engine compartment cover, which generates a forward air flow above a hopper in the direction of travel of the road paver, with which the rising vapors and/or aerosols from the hopper can be covered.

DE 10 2020 123 723 A1 discloses a road paver which, viewed in the paving direction, has at least one air nozzle unit upstream of the paving screed for generating a vertical and/or a horizontal air curtain, the air curtain produced by means of the air nozzle unit delimiting the area between a first side plate and a second side plate of the paving screed so that vapors of the paving material can be extracted more easily from this area by an extraction device. Such an air curtain has the same technical effect as a horizontal or vertical cover around the area of the distribution auger. Furthermore, DE 10 2020 123 723 A1 discloses an air nozzle unit arranged on an operating platform of the road paver to create an air curtain around the operating platform so that vapors cannot enter the area of the operating platform.

SUMMARY

It is an object of the disclosure to provide a road construction machine, in particular a road paver or a feeder vehicle for a road paver, on which vapors and/or aerosols can be kept away from the operating personnel of the road construction machine even better. Furthermore, it is an object of the disclosure to provide a corresponding method.

This object is solved by a road construction machine according to the disclosure or by a method according to the disclosure.

The disclosure refers to a road construction machine, adapted in particular in the form of a road paver or feeder vehicle for a road paver. The road construction machine according to the disclosure comprises at least one operating platform for a driver of the road construction machine and/or an external control station for an operator of the road construction machine. Furthermore, the road construction machine according to the disclosure comprises at least one first air barrier device for the driver of the road construction machine and/or at least one second air barrier device for the operator of the external control station of the road construction machine. Furthermore, the road construction machine according to the disclosure comprises a hopper arranged in front of the operating platform in the direction of travel and having lateral hopper halves for receiving a paving material.

The disclosure is characterized in that, viewed from above, the first air barrier device is adapted to generate at least one directed air flow in the form of an air wall extending within an area present laterally of the operating platform and/or in that the second air barrier device is adapted to generate at least one directed air flow in the form of an air wall extending within an area present laterally of the external control station.

The aforementioned areas are located, when viewed in a top view, at the side of the actual geometry of the road construction machine and are readily used in practice by the driver and/or operator to control and/or monitor the operation of the road construction machine from there. The air wall formed according to the disclosure within these exterior areas creates an air barrier to seal off the driver and/or operator from vapors and/or aerosols. Furthermore, the air flow used to create the air wall can provide a suction effect to remove air that may be contaminated with vapors and/or aerosols.

In the disclosure, the operating platform can have open outer sides as viewed in the direction of travel. Vapors and/or aerosols can conventionally be drawn into the area of the operating platform through these open outer sides. The air wall according to the disclosure can be formed adjacent to the operating platform, i.e., within a laterally adjacent zone of the operating platform, in such a way that vapors and/or aerosols can be better kept away from the open outer sides.

The air wall generated outside the operating platform by means of the first air barrier device makes it possible in particular to seal off the area to the side of the operating platform from vapors and/or aerosols rising from the hopper, in particular from the lateral hopper halves. In particular, this positive sealing effect for the driver of the road construction machine is achieved when he is positioned to the side of the operating platform, for example when the driver's seat console used by him is swiveled out to the side, beyond the operating platform, as a result of which the driver himself is positioned within this zone, i.e., to the side next to the operating platform.

Another positive side effect is that aerosols and/or vapors rising next to the operating platform can be blown sideways away from the driver by means of an air flow directed into the side area to form the air wall, regardless of whether the driver's seat console is swiveled out or not.

The air wall created adjacent to the external control station by means of the second air barrier device offers an operator positioned to the side of the external control station a comparable sealing-off effect against rising vapors and/or aerosols as the first air barrier device to the side of the operating platform. In particular, vapors and/or aerosols from a transverse spreader duct can be better kept away from the driver.

Since in practice the driver and/or the operator like to stay at the side of the road construction machine, in particular laterally offset to the operating platform and/or laterally adjacent to the external control station, for them an air wall formed in these zones is particularly effective for sealing off rising vapors and/or aerosols.

Preferably, the air wall generated by means of the first and/or by means of the second air barrier device is adapted as an air wall intersecting the direction of travel of the road construction machine. In particular, the air flow for generating the air wall can be blown out sideways from the road construction machine at right angles to the direction of travel or at a predetermined angle to it. This achieves a double effect. On the one hand, the air wall formed in this way can as such excellently shield a driver and/or operator positioned within the side zones, i.e., a driver and/or operator positioned adjacent to the operating platform and/or a driver and/or operator positioned external to the external control station, from rising vapors and/or aerosols. Such an air wall forms, so to speak, an air curtain for the driver and/or the operator of the road construction machine, which serves to at least reduce vapors and/or aerosols in his lateral occupied zone. On the other hand, the air flow emitted by the road construction machine to the outside or tending to the front at an angle can transport aerosols and/or vapors sideways away from the driver and/or operator. For example, the generated air wall is built adjacent to the operating platform and/or adjacent to the external operating station within adjacent zones at an angle of between 30° and 60° to the direction of travel.

According to an embodiment of the disclosure, the first air barrier device comprises at least one nozzle arranged on a roof segment which can be extended transversely to the direction of travel, at least one nozzle arranged on a driver's seat console which can be swiveled out sideways with respect to the operating platform, at least one nozzle arranged on an A-pillar of a roof structure and/or at least one nozzle arranged on the hopper halves for generating the air wall. Using these variants, the area to the side of the operating platform can be effectively sealed off from rising vapors and/or aerosols.

It is conceivable that the nozzle of the first air barrier device is integrally formed on a component of the extendable roof segment. In particular, the nozzle is arranged on a carrier of the extendable roof segment facing the hopper, for example on it in the form of a blowing bar which extends essentially along the carrier. The air wall that can be generated by means of this blowing bar from top to bottom within the area mounted laterally to the operating platform is essentially transverse to the direction of travel of the road construction machine and can excellently shield a driver positioned behind it, outside the operating platform, or a driver positioned on the operating platform from vapors and/or aerosols rising from the hopper area.

Preferably, the nozzle of the first air barrier device is integrally formed on a substructure of the driver's seat console, for example on a floor panel, and/or integrally formed on a fall-out protection of the driver's seat console, for example within a railing section. This ensures that the air wall which can be generated by means of the nozzle is directly associated with the driver's seat console and thus with the driver sitting thereon for shielding from vapors and/or aerosols, in particular when the driver's seat console is swiveled out laterally beyond the operating platform. It would be possible, for example, for the nozzle to extend along an outer edge of the substructure lying at the front in the direction of travel or to be formed as part of an upper railing section of the fall-out protection, for example in the form of a cylindrical tube with a number of exhaust openings which serve to generate the directed air flow.

One variant provides for the nozzle of the first air barrier device to be integrated within the A-pillar, so that the A-pillar forms a housing for the nozzle. For example, the A-pillar is adapted in the form of a hollow profile, with the nozzle extending in the form of a pipe at least in sections within the A-pillar. In this case, nozzle exhaust openings could be aligned with exhaust openings formed in the A-pillar to create the air wall according to the disclosure for protecting the driver from rising vapors and/or aerosols.

Preferably, the first air barrier device comprises a first nozzle mounted along the A-pillar and a second nozzle mounted along a B-pillar positioned behind the A-pillar in the direction of travel, so that the two air walls generated at a distance from one another by means of these nozzles form an air duct at the side of the operating platform that is limited at least to the front and rear for the driver positioned in this zone. This means that the driver, in particular if he is positioned on the driver's seat console to the side of the operating platform, can be shielded both from vapors and/or aerosols from the hopper area and from vapors and/or aerosols rising from a transverse spreader duct behind him in the direction of travel.

An advantageous embodiment of the disclosure provides that the nozzle of the first air barrier device is formed inside an upper edge of the hopper half. In this way, in particular, vapors and/or aerosols rising from an outer area of the hopper halves can be shielded off directly at the upper edge of the hopper. Preferably, the nozzle extends at least in sections along an upper edge of a rear wall of the hopper half and/or at least in sections along an upper edge of an outer wall of the hopper half, in order advantageously to intercept, dilute and transport away the vapors and/or aerosols rising from the outer area of the hopper. The air wall created in this way forms a functional extension on the rear wall of the hopper and/or on the outer wall of the hopper and can form an air side wall extending beyond the hopper wall made of metal. This allows vapors and/or aerosols from the hopper to be both better shielded and better transported away upwards above a height level of the driver and other operators working in the area of the road construction machine.

It is conceivable that the first air barrier device or at least one blower device provided on the road construction machine and supporting the first air barrier device is adapted to generate at least one directed air flow in the form of an air wall, which is assigned in the direction of travel at least in sections along a front area of the operating platform. This air wall can extend in the direction of travel directly in front of the operating platform and, in particular, project as an air barrier from the operating platform.

Preferably, the air flow formed along the front area of the operating platform has the same flow direction as the airflow generated by the first air barrier device for generating the airflow within the area laterally of the operating platform. For example, both of these air flows can be controlled in such a manner, that within the lateral area these air flows align with each other to form an enlarged, closed air barrier for the driver of the road construction machine.

In particular, it would be possible for the air flow formed in front of the operating platform to be directed transversely to the direction of travel in order to entrain any air contaminated with aerosols and/or vapors sideways from the front area of the operating platform. In other words, contaminated air can thus be forced sideways out of the driver's area. This can further improve the air quality in the area of the operating platform. To generate a substantially horizontal air flow directed transversely to the direction of travel, for example, a nozzle mounted at least in sections along the A-pillar, preferably integrated therein, could be used. The air flow generated by this nozzle can extend from the A-pillar with the nozzle in the form of an air wall in a transverse direction to a further A-pillar arranged laterally offset.

As an alternative to the horizontal air flow between the two A-pillars described above, which is formed transversely to the direction of travel, the air wall generated in front of the operating platform could be formed by means of an upwardly directed air flow flowing out of an engine cover part adjacent to the front area of the operating platform. In particular, such an air flow, which is preferably directed vertically upwards, can entrain contaminated air upwards, i.e., transport it away to an area above the operator.

One variant provides for the air flow formed in front of the operating platform to be in the form of an air wall formed directly behind a windshield in the direction of travel. The windshield can thus be freed from fogging and can also serve as a guide geometry for the air flow. In addition, an air wall running essentially parallel to the windshield and formed directly behind it has the advantage that it does not blow against the driver on the operating platform.

Preferably, the second air barrier device has at least one nozzle arranged on a sideshift of the external control station for generating the air wall and/or at least one nozzle arranged on a roof of the external control station for generating the air wall. On the sideshift of the external control station, the nozzle could be in the form of a substantially vertical blowing bar in order to generate an air wall for shielding vapors and/or aerosols in the area adjacent to the external control station, laterally offset in the direction of travel. Preferably, the nozzle arranged on the roof of the external control station is arranged along a front support of the roof mounted transversely to the direction of travel in order to form an air curtain directed from top to bottom at the side of the external control station directly in front of an operator positioned thereunder.

According to an embodiment, it is provided that the second air barrier device comprises at least one nozzle arranged at a rear screed wall for generating an upwardly directed air flow and/or at least one nozzle arranged below a screed walkway for generating an air flow directed against the direction of travel of the road construction machine. Such nozzles can effectively supplement the air wall generated by means of the second air barrier device at the side of the external control station in order to additionally protect the operator of the external control station, even if he changes the side of the paving screed via the walkway attached to the rear wall of the screed, from rising vapors and/or aerosols. A nozzle arranged underneath the screed walkway would have the advantage, above all, that the air wall created with it could spread like a carpet above a newly paved paving layer, allowing vapors and/or aerosols to be kept on the surface of the newly produced paving layer.

It is conceivable that the nozzle arranged along the rear screed wall and/or the nozzle arranged below the screed walkway can generate an air flow that can be dynamically adjusted depending on a distance measurement to a following compaction vehicle, for example to a roller. For example, if the distance to the following compaction vehicle is measured shortly, the air flow produced by means of these nozzles could be increased automatically in order to better protect the driver of the following compactor vehicle from rising aerosols and/or vapors.

Preferably, the first and/or the second air barrier device can be operated by means of a fan formed in the engine compartment of the road construction machine for generating a cooling air flow and/or comprises at least one filter unit for cleaning air conveyed therein. Such a fan thus fulfills a dual function in that, on the one hand, it generates the cooling air flow for discharging heat in the area of the engine and, on the other hand, it can be used as a drive for the first and/or second air barrier device.

It is advantageous if a volume flow generated by means of the first and/or the second air barrier device can be varied dynamically depending on a set and/or detected process parameter of the road construction machine. For example, the first and/or second air barrier device could be connected to a control device configured to dynamically control the fan speed of a separate fan drive or the aforementioned fan based on the temperature of the paving material.

Regardless of whether it is a nozzle of the first and/or the second air barrier device, this can be adapted in the form of a rail or a blowing bar which has several blow-out openings. An air wall generated in this way can thus be adapted directly as a visible boundary of the outer working areas available to the driver and/or the operator of the external control station.

BRIEF DESCRIPTION OF THE DRAWINGS

Advantageous embodiments of the disclosure are explained in more detail with reference to the following figures.

Identical components are marked with the same reference numerals throughout the Figures.

DETAILED DESCRIPTION

Figure 1:
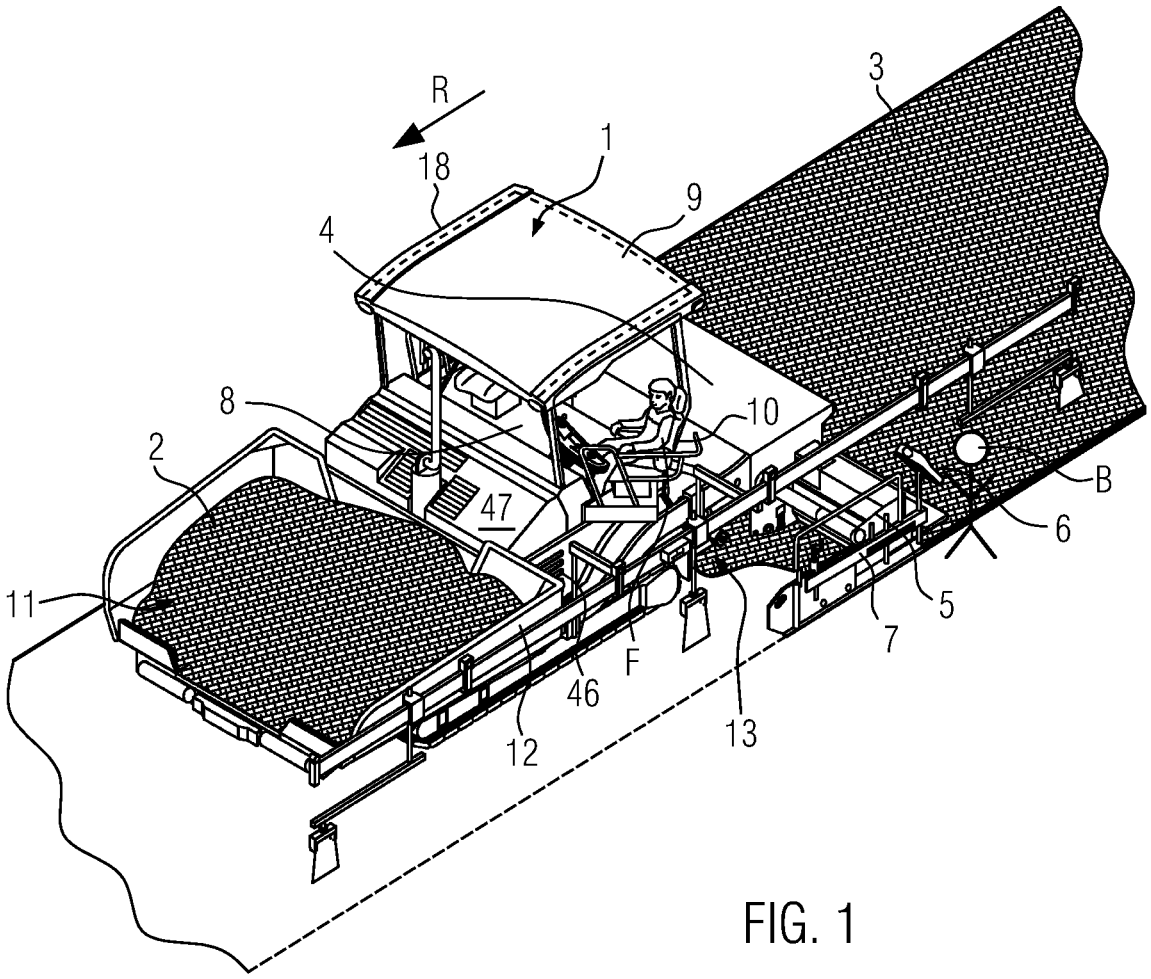
FIG. 1 shows the road construction machine according to the disclosure in the form of a road paver during a paving operation.

FIG. 1 shows a road construction machine in the form of a road paver 1. The road paver 1 is configured to produce a paving layer 3 from a paving material 2 in the direction of travel R. To produce the paving layer 3, the road paver 1 has a paving screed 4 whose produced pave width is adjustable by means of extendable extending units 5. An external control station 6 for an operator B is provided on the extending unit 5 shown in FIG. 1. At the external control station 6, the operator B can set and monitor working functions of the screed 4, in particular of the extending unit 5. The external control station 6 is attached to a sideshift 7. The sideshift 7 limits the width of the produced paving layer 3.

The road paver 1 shown in FIG. 1 also has an operating platform 8, which is located below an overhead guard 9. On the operating platform 8, a driver F of the road paver 1 can control and monitor work processes running on the road paver 1.

FIG. 1 further shows that the driver F of the road paver 1 is positioned on a driver's seat console 10, which is swiveled laterally out of the area of the operating platform 8, so that the driver F can better overlook processes running on the road paver 1, in particular a filling level of the paving material 2 received in front of him inside a hopper 11.

In FIG. 1, the paving material 2 is stored inside the hopper 11 up to lateral hopper halves 12. The paving material 2 stored inside the hopper 11, in particular inside the lateral hopper halves 12, is transported backwards to the paving screed 4 by means of a longitudinal conveying device (not shown) against the direction of travel R of the road paver 1 and distributed in front of the paving screed 4 within a transverse spreader duct 13 in the direction of the extending units 5. The paving material 2 thus distributed transversely in front of the paving screed 4 and the extending units 5 formed thereon is compacted into the paving layer 3 during the paving travel of the road paver 1.

Figure 2:
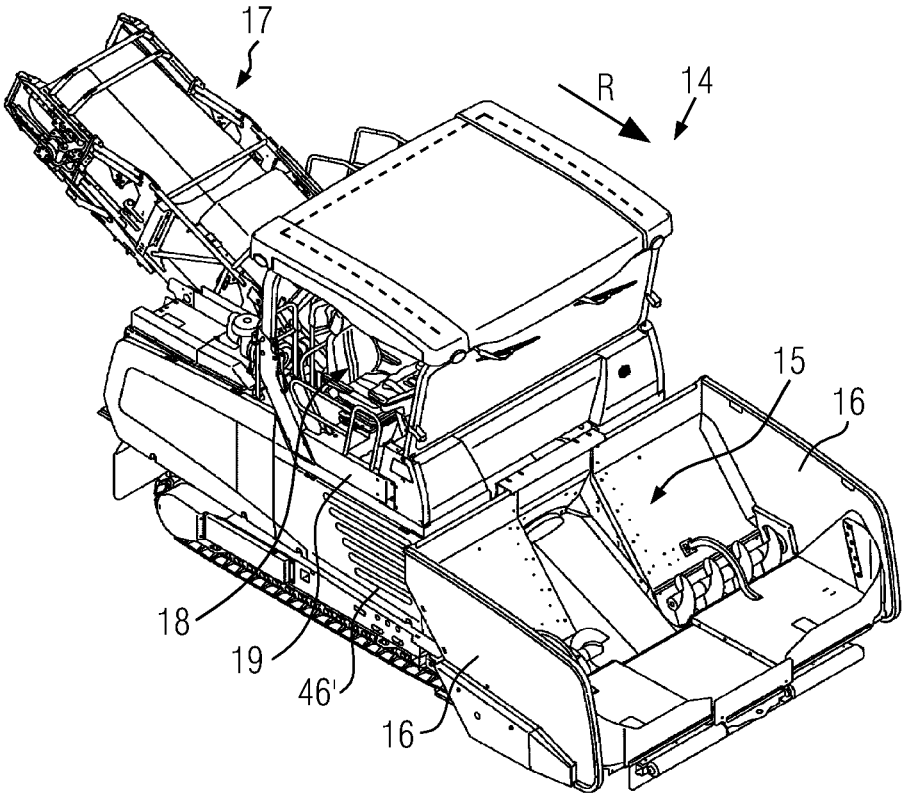
FIG. 2 shows the road construction machine according to the disclosure in the form of a feeder vehicle for a road paver.

FIG. 2 shows a road construction machine in the form of a feeder vehicle 14. During a material transfer process, the feeder vehicle 14 can travel ahead of the road paver 1 shown in FIG. 1 in the direction of travel R and supply its hopper 11 with paving material 2. The feeder vehicle 14 shown in FIG. 2 has a hopper 15 comprising lateral hopper halves 16. During a material transfer process, the paving material 2 is transported from the hopper 15 of the feeder vehicle 14 to a feeder belt 17 by means of a longitudinal conveyor in the opposite direction to the direction of travel R and is thrown by this longitudinal conveyor into the hopper 11 of the road paver 1 which is following closely behind.

The feeder vehicle 14 shown in FIG. 2 has an operating platform 18 that is structurally similar to the operating platform 8 shown in FIG. 1. In particular, the feeder vehicle 14 of FIG. 2 may also have a swivel-out driver's seat console 19 for a driver F.

Figure 3:
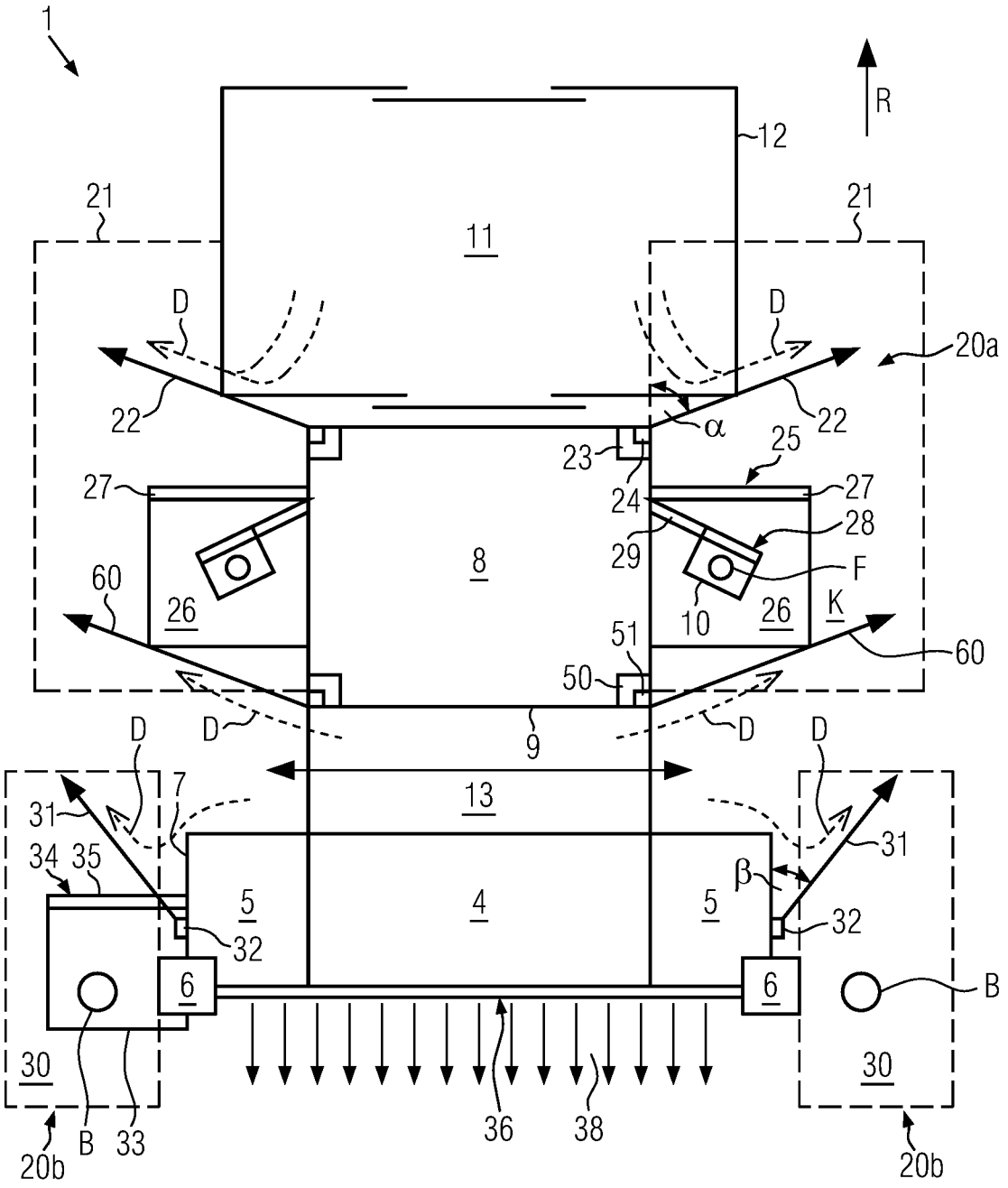
FIG. 3 shows a schematic view of a road paver from the top view with air barrier zones set up next to the operating platform and next to an external control station.

FIG. 3 shows a schematic view of the road paver 1. The road paver 1 has a first air barrier device 20*a*, which creates an air wall 22 within an area 21 positioned to the side of the operating platform 8, by means of which rising vapors and/or aerosols D, in particular those from the hopper halves 12, can be shielded from the driver F who is positioned within the area 21, and can be transported away to the side. This air barrier principle is shown in FIG. 3 on both laterally adjacent zones of the operating platform 8.

In FIG. 3, it is shown that the first air barrier device 20*a* comprises a nozzle 24 positioned inside an A-pillar 23 to generate the air wall 22 at an angle $\alpha$ with respect to the direction of travel R. Alternatively or complementarily, an air wall serving to protect the driver F positioned within the area 21 could also be generated by means of a nozzle 27 arranged on a front edge 25 of an extendable roof segment 26 and/or by means of a nozzle 29 formed on a substructure 28 of the extendable driver's seat console 10. On the other side of the road paver 1, there could be a similar nozzle assembly for generating the air wall 22 and/or another air wall located within the area 21.

FIG. 3 also shows a B-pillar 50 for the overhead guard 9, which is positioned behind the A-pillar 23 in the direction of travel R. An air wall 60 is blown out of the B-pillar 50 by means of a nozzle 51 installed in it, which together with the air wall 22 blown out of the A-pillar 23 further forward forms an air duct K for the driver F. The driver F shown in FIG. 3 is shielded both from vapors and/or aerosols D rising from the hopper area in front of him and from vapors and/or aerosols D rising from the transverse spreader duct 13 behind him.

The first air barrier device 20*a* shown in FIG. 3, described above, may be installed in a similar manner on the feeder vehicle 14 of FIG. 2.

FIG. 3 further shows a second air barrier device 20*b*, which is associated in particular with a lateral area 30 of the external control station 6 in order to generate in this zone an air wall 31 blown out at an angle ß with respect to the direction of travel R. The air wall 31 protects an operator B of the external control station 6 positioned within the area 30 from vapors and/or aerosols D rising from the transverse spreader duct 13.

FIG. 3 further shows that the second air barrier device 20*b* generates the air wall 31 by means of a nozzle 32 positioned at the sideshift 7. FIG. 3 further shows that a roof 33 for the operator B is provided for the external control station 6 of the left side of the screed. On the roof 33 shown in FIG. 3, a nozzle 35 is formed along a front edge 34 for forming a vertical air curtain directed from top to bottom in front of the operator B in the direction of travel R.

FIG. 3 shows that the second air barrier device 20*b* is formed on both the left and right external control station 6. Furthermore, FIG. 3 shows that another nozzle 37 is formed along a screed rear wall 36 to create an upwardly directed air wall 45 (see FIG. 5B) substantially along the set screed width, which rises as an air wall between the road paver 1 and a following compactor vehicle.

FIG. 3 further shows an air flow 38 blown out behind the paving screed 4 in the opposite direction to the direction of travel R, which covers the produced paving layer 3 in the form of an air carpet.

Figure 4:
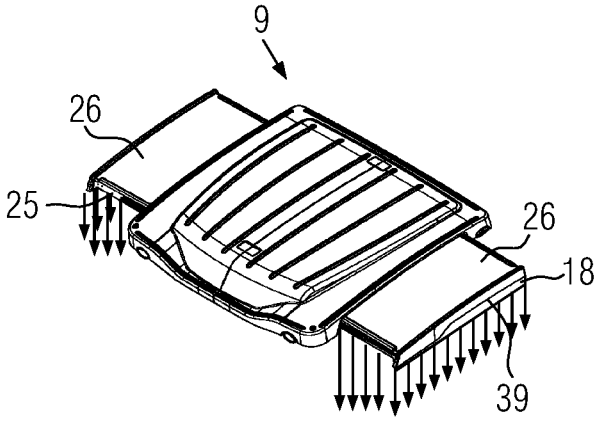
FIG. 4 shows an operator's protecting roof with retractable roof segments.

FIG. 4 shows the overhead guard 9 with extendable roof segments 26 that can be used for the road paver 1 in FIG. 1. The overhead guard 9 can also be used for the feeder vehicle 14 shown in FIG. 2. In FIG. 4, the roof segments 26 are in extended position. The extension of one of the two roof segments 26 takes place, for example, automatically in response to a swiveling-out of the driver's seat console 10, 19 positioned below it. Air flows out downwards at the front edge 25 of the two roof segments 26 in order to form an air wall for the driver F within the area 21 (see FIG. 3). Furthermore, FIG. 4 shows that an air flow directed from top to bottom emerges along an outer edge 39 of the roof segments 25. In this way, a driver F positioned below can be shielded inside an air cabin from vapors and/or aerosols D rising from the hopper area.

Figure 5A:
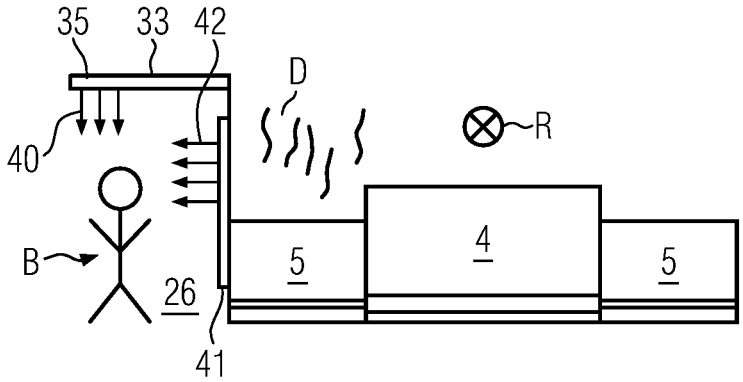
FIG. 5A shows a schematic view of an external control station with a roof and an air barrier device formed thereon.

FIG. 5A shows a schematic view of the paving screed 4 viewed from the rear in the direction of travel R with the extending units 5 and an external control station 6 arranged thereon with a roof 33. An air flow 40 emerges from the roof 33 from above from the nozzle 35 in front of the operator B positioned below. FIG. 5A further shows a vertically installed nozzle 41 for blowing out an air flow 42 directed sideways, which blows away vapors and/or aerosols sideways in front of the operator B.

Figure 5B:
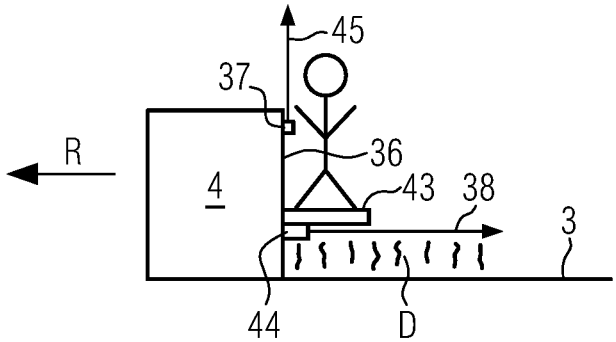
FIG. 5B shows a schematic view of a supplementary air barrier device for the external control station.

FIG. 5B shows in schematic view that a further nozzle 44 is arranged below a walkway 43 attached to the rear wall of the screed 36. The nozzle 44 is adapted to generate underneath the walkway 43 an air flow 38 directed against the direction of travel R directly above the paving layer 3 in order to cover vapors and/or aerosols D rising from the paving layer 3.

The first and/or second air barrier device 20*a*, 20*b* shown in the Figures can draw in air through an engine compartment opening 46, 46' shown in FIGS. 1 and 2 directly above the undercarriage of the road paver 1 or the feeder vehicle 14.

What is claimed is:

1. A road construction machine configured as a road paver or a feeder vehicle for a road paver, comprising an operating platform for a driver of the road construction machine and/or an external control station for an operator of the road construction machine, a first air barrier device for the driver of the road construction machine and/or a second air barrier device for the operator of the external control station of the road construction machine, as well as a hopper arranged in front of the operating platform in a direction of travel and having lateral hopper halves for receiving a paving material, wherein, viewed from above, the first air barrier device is adapted to generate at least one directed air flow in a form of an air wall extending within an area present laterally of and adjacent to the operating platform and/or the second air barrier device is adapted to generate at least one directed air flow in a form of an air wall extending within an area present laterally of and adjacent to the external control station.

2. The road construction machine according to claim 1, wherein the air wall generated by means of the first air barrier device and/or by means of the second air barrier device is adapted as an air wall intersecting the direction of travel of the road construction machine.

3. The road construction machine according to claim 1, wherein the first air barrier device comprises at least one nozzle arranged on a roof segment extendable transversely to the direction of travel, at least one nozzle arranged on a driver's seat console which can be swiveled out sideways relative to the operating platform, at least one nozzle arranged on an A-pillar of a roof structure and/or at least one nozzle arranged on the hopper halves for generating the air wall.

4. The road construction machine according to claim 3, characterized in that the at least one nozzle of the first air barrier device is integrally formed on a component of the extendable roof segment, integrally formed on a substructure or on a fall-out protection of the driver's seat console, integrally formed within the A-pillar and/or integrally formed within an upper edge of a hopper half of the hopper halves.

5. The road construction machine according to claim 1, wherein the first air barrier device or at least one fan device supporting the first air barrier device is adapted to generate at least one directed air flow in a form of an air wall associated in the direction of travel at least in sections along a front area of the operating platform.

6. The road construction machine according to claim 1, wherein the second air barrier device comprises at least one nozzle arranged on a sideshift of the external control station for generating the air wall and/or at least one nozzle arranged on a roof of the external control station for generating the air wall.

7. The road construction machine according to claim 1, wherein the second air barrier device comprises at least one nozzle arranged at a rear screed wall for generating an upwardly directed air flow and/or at least one nozzle arranged below a screed walkway for generating an air flow directed against the direction of travel of the road construction machine.

8. The road construction machine according to claim 1, wherein the road construction machine comprises at least one lateral engine compartment opening for drawing in air for the first air barrier device and/or the second air barrier device.

9. The road construction machine according to claim 1, wherein the first barrier device and/or the second air barrier device are/is operable by means of a fan formed in an engine compartment of the road construction machine for generating a cooling air flow and/or comprises at least one filter unit arranged in the engine compartment for cleaning air conveyed thereby.

10. The road construction machine according to claim 1, wherein a volume flow generated by means of the first air barrier device and/or the second air barrier device can be varied dynamically depending on a set and/or detected process parameter of the road construction machine.

11. The road construction machine according to claim 1, wherein, viewed from above, the first air barrier device is adapted to generate the at least one directed air flow in the form of the air wall extending within the area present laterally of and adjacent to the operating platform so that rising vapors and/or aerosols are transported away to a side of the road construction machine, and/or the second air barrier device is adapted to generate the at least one directed air flow in the form of the air wall extending within the area present laterally of and adjacent to the external control station so that rising vapors and/or aerosols are transported away to a side of the road construction machine.

12. A method for generating an air flow during operation of a road construction machine configured as a road paver or a feeder vehicle for a road paver, the method comprising generating, by a first air barrier device of the road construction machine, at least one directed air flow in a form of an air wall extending within an area present laterally of and adjacent to an operating platform of the road construction machine when viewed from above, and/or generating, by a second air barrier device, at least one directed air flow in a form of an air wall extending within an area present laterally of and adjacent to an external control station of the road construction machine when viewed from above.

13. The method according to claim 12, wherein the method comprises generating the air wall by the first air barrier device so that the air wall intersects a direction of travel of the road construction machine.

14. The method according to claim 12, wherein the method comprises generating the air wall by the second air barrier device so that the air wall intersects a direction of travel of the road construction machine.

15. The method according to claim 12 further comprising varying a volume flow generated by the first air barrier device and/or the second air barrier device dynamically depending on a set and/or detected process parameter of the road construction machine.

16. The method according to claim 12, wherein the first air barrier device generates the at least one directed air flow in the form of the air wall extending within the area present laterally of and adjacent to the operating platform so that rising vapors and/or aerosols are transported away to a side of the road construction machine, and/or the second air barrier device generates the at least one directed air flow in the form of the air wall extending within the area present laterally of and adjacent to the external control station so that rising vapors and/or aerosols are transported away to a side of the road construction machine.

17. A road construction machine configured as a road paver or a feeder vehicle for a road paver, comprising an operating platform for a driver of the road construction machine and/or an external control station for an operator of the road construction machine, the road construction machine further comprising a first air barrier device for the driver of the road construction machine and/or a second air barrier device for the operator of the external control station of the road construction machine, wherein, viewed from above, the first air barrier device is configured to generate at least one directed air flow in a form of a first air wall extending within an area present laterally of and adjacent to the operating platform so that the first air wall extends away from a perimeter of the road construction machine and/or the second air barrier device is configured to generate at least one directed air flow in a form of a second air wall extending within an area present laterally of and adjacent to the external control station so that the second air wall extends away from the perimeter of the road construction machine.

18. The road construction machine according to claim 17, wherein, viewed from above, the first air barrier device is adapted to generate the first air wall so that rising vapors and/or aerosols are transported away to a side of the road construction machine, and/or the second air barrier device is adapted to generate the second air wall so that rising vapors and/or aerosols are transported away to a side of the road construction machine.

19. The road construction machine according to claim 17, wherein the road construction machine comprises the operating platform and a hopper arranged in front of the operating platform in a direction of travel, and wherein the hopper is configured to receive a paving material.

* * * * *